United States Patent [19]

Gianelo

[11] 4,131,002

[45] Dec. 26, 1978

[54] DOOR LATCH

[76] Inventor: Angelo Gianelo, 1383 S. 1900 East, Salt Lake City, Utah 84108

[21] Appl. No.: 828,283

[22] Filed: Aug. 29, 1977

[51] Int. Cl.[2] ..... E05C 3/08

[52] U.S. Cl. ..... 70/84; 292/226

[58] Field of Search ..... 70/84; 292/11, 13, 18, 292/19, 48, 52, 56, 85, 126, 223, 226

[56] References Cited

U.S. PATENT DOCUMENTS

| | | | |
|---|---|---|---|
| 2,010,492 | 8/1935 | Karre | 292/226 X |
| 2,014,587 | 9/1935 | Roedding | 292/226 X |
| 2,534,693 | 12/1950 | Adams | 292/223 |
| 3,051,520 | 8/1962 | Poe | 292/223 |
| 3,149,867 | 9/1964 | Odendhal | 292/226 |
| 3,338,610 | 8/1967 | Pelcin et al. | 292/126 |
| 3,758,140 | 9/1973 | Prete | 292/226 X |
| 3,836,185 | 9/1974 | Touchstone | 292/223 X |

*Primary Examiner*—J. Franklin Foss

*Attorney, Agent, or Firm*—Trask & Britt

[57] ABSTRACT

A door latch for use with metal lockers or compartments frequently found on service trucks, panel trucks and the like, includes a mounting member with a recess formed into its front. A shaft is positioned in the recess. A latch member is mounted to the shaft and extends through an aperture formed in the recess. The aperture is sized so that the latch member is rotatable between a latched position and an unlatched position. Biasing means mounted to the back of the base member biases the latch member in the latched position. A lever is mounted to the shaft with means to coact with the latch member to rotate the latch member from the latched position to the unlatched position. The lever preferably is mounted with a pawl extending from a first edge along the front of the latch member so that as the lever is pulled outwardly from the recess the pawl contacts the latch member and causes it to rotate.

7 Claims, 4 Drawing Figures

DOOR LATCH

BACKGROUND OF THE INVENTION

1. Field

This invention relates to door latches. More particularly, this invention relates to door latches for use with lockers or compartments.

2. State of the Art

A variety of door latches have been devised for uses which may typically include use with metal lockers, compartments or the like found on service trucks, panel trucks, pickup trucks and the like. Such latches are exposed to the weather elements which in turn can present additional factors which must be taken into account to devise an effective, reliable and durable door latch. For example, the outside environment imposes problems with respect to corrosion, dirt, grease and in some cases rugged use.

Latches heretofore known include the latch disclosed in U.S. Pat. No. 3,668,907 (Pastva, Jr).). As disclosed, that latch has a bolt operated by fingers which are moved by a paddle. The bolt is positioned within a housing and slides through the housing along its length. In use, the bolt and housing suffer corrosion so that sliding contact is difficult which in turn inhibits operation. Further, the forces necessary to operate the bolt upon opening or closing the door are relatively large in view of the fact that force resolution requires a strong component along the axial length of the bolt which as disclosed is mounted parallel to the face or exterior of the panel or door which is to be latched or locked.

Other patents which similarly teach the use of latch bolts mounted parallel to the face of the door include U.S. Pat. Nos. 2,668,076 (Troche, et al.); 2,916,905 (Podlesak); 2,871,048 (Balogh); 3,782,141 (Doerrfeld); 2,987,908 (Pelcin); 3,743,336 (Andrews); and 2,642,300 (Pelcin). Each of the devices disclosed in the above noted patents requires a translation or resolution of forces to cause a horizontally mounted bolt to move in a direction parallel to the face of the door. Further, the bolts are contained generally within housings or other structure so that corrosion with respect to the bolt, adjoining surface parts and related items will tend to foul and further increase the frictional relationship between the bolt and its adjoining structure. In turn, operation of the latch becomes difficult, and in some cases, impossible.

Other latches known in the art include a plurality of moving parts or other structure which is assembly make them costly, difficult to repair, susceptible to breakage and otherwise generally unreliable because of the propensity for fouling from dirt and corrosion. Devices of this nature include those disclosed in U.S. Pat. Nos. 2,322,892 (Springer); and 1,995,106 (Roedding).

Other latches which may be of interest include latches for use with refrigerators, kitchen cabinets, appliances, airplanes and the like as follows: U.S. Pat. Nos. 1,882,246 (Madsen); 3,017,760 (Jones); 2,772,108 (Ellis); 2,440,350 (Shafer); 219,485 (Kaye). Other patents of interest include U.S. Pat. Nos. 2,474,519 (Drzewiecki); 3,758,140 (Prete, Jr.); 1,877,612 (Stieglitz); 2,371,048 (Balogh). However, these latches are generally not suitable for outdoor use or for use as herein stated.

SUMMARY OF THE INVENTION

A door latch includes a mounting member having mounting means and a recess formed therein. The recess has a bottom with an aperture formed therein. A shaft is secured to the mounting member in the recess proximate the aperture. A latch member is mounted to the shaft to extend from the recess through the aperture. The latch member has a striking surface inward of the bottom of the recess. The aperture is sized so that the latch member is rotatable between a latched position and an unlatched position. Biasing means are mounted to the base member to bias the latch member toward the latched position. A lever is mounted to the shaft with means to coact with the latch member to rotate the latch member from the latched position to the unlatched position.

The biasing means may include a housing mounted to and inwardly from the bottom proximate the latch member and a spring compressably mounted between the housing and the latch member. The latch member has a bottom, top, front and back. The latch member is mounted to the shaft proximate its bottom. The back of the latch member abuts the spring. The front of the latch member includes a striking surface which angles from the top of the latch member frontwardly and toward the bottom to form a latching lip.

In another embodiment, the lever is positioned within the recess and has a first edge opposite a second edge and is mounted to the shaft along its first end. The lever has a pawl extending inwardly from the first edge along the front of the latch member so that upon movement of the second edge outwardly from the recess, the pawl contacts the latch member and applies a rotational force to rotate the latch. The striking surface is preferably oriented outwardly from the mounting member. The latch member preferably has two spaced apart legs extending along its bottom towards its front. The latch member is mounted to the shaft through the legs, the pawl being positioned between the legs. The mounting member is desirably rectalinear in shape and formed with a flange about its perimeter. The recess is rectalinear in shape with the lever being flushly mounted therein. The lever is preferably a rectalinearly shaped paddle.

In a preferred embodiment, the latch includes a striking plate mounted to a adjoining structure. The plate has a striking surface angulated substantially identically to the same angle as the striking surface of the latch member. The striking plate has a lip and is positioned to coact with the latch member.

In a preferred embodiment, locking means are mounted to the lever. The locking means includes a pawl to interact with a corresponding member to receive said pawl mounted to the bottom of the recess.

BRIEF DESCRIPTION OF THE DRAWINGS

In the drawings, which illustrate what is presently regarded as the best mode for practicing the invention.

DESCRIPTION OF THE ILLUSTRATED EMBODIMENT

Figure 1:
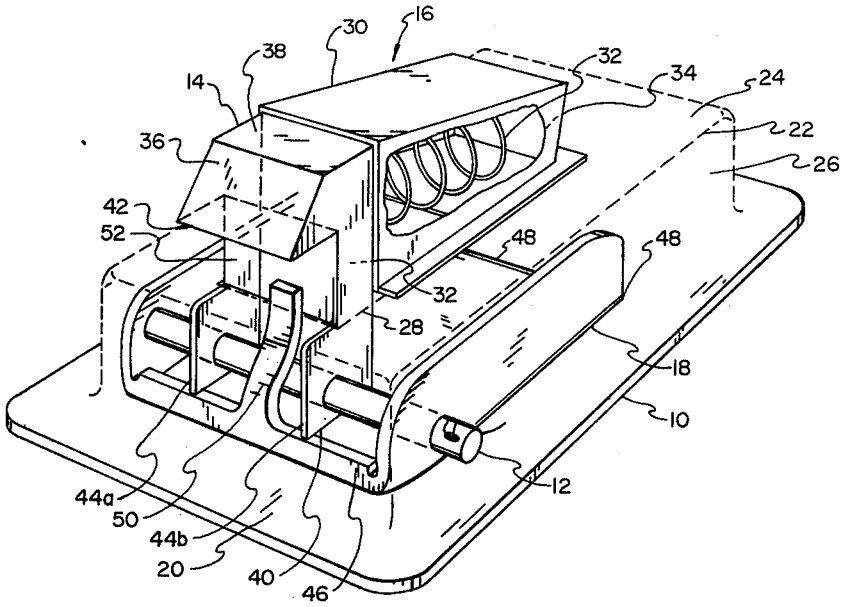
FIG. 1 is a perspective cut-away view of a door latch of the instant invention.

The door latch of the instant invention includes a mounting member 10, shaft 12, a latch member 14, biasing means 16 and a lever 18. The mounting member 10 is preferably formed out of a strong and durable metal, preferably non-corrosive. For example, the metal may be galvanized steel, stainless steel, or the like. The mounting member 10 has a flange 20 about its perimeter. A recess 22 is formed in the mounting member to have a bottom 24 and side 26. As shown in FIG. 1, the mounting member 10 and the recess 22 are preferably rectalinear in shape. The recess 22 has an aperture 28 formed in the bottom 24. The shaft 12 is secured to the mounting member 10 in the recess 22 proximate the aperture 28. The latch member 14 is mounted to the shaft 12 to extend from the recess 22 through the aperture 28 inwardly of the bottom 24. The aperture 28 is sized so that the latch member 14 is rotatable between a latched position as shown in FIG. 1, and the unlatched position, as shown in the dotted outline 14*a* and 18*a* in FIG. 2. The biasing means 16 is secured to the mounting member 10 to bias the latch member 14 toward the latched position. The lever 10 is mounted to the shaft 12 with means to coact with the latch member 14 is rotate the latch member 14 from the latched position to the unlatched position upon operation of the lever 18.

The biasing means 16 preferably includes a housing 30 mounted to the bottom 24 of the recess 22. A spring 32 is compressably mounted within the housing 30 between the back 32 of the latch member 14 and the back 34 of the housing 30. It may be noted that the housing 30 is sized to receive the latch member 14 therewithin as the latch member rotates from the latched position to the unlatched position. The housing 30 is also sized so that the latch member 14 does not physically contact any of the internal surfaces of the housing 30. Other biasing means, as known to those skilled in the art, may also be employed to bias the latch to the unlatched position.

The latch member 14 has a striking surface 36 which angles from the top 38 of the latch member 14 frontwardly toward the bottom 40 to form a latching lip 42. The latch member 14 has two spaced apart legs 44*a* and 44*b* extending along its bottom frontwardly. The latch member 14 is mounted to the shaft 12 through apertures formed in the legs 44*a* and 44*b*.

The lever 18 has a first edge 46 opposite a second edge 48. The lever is mounted to the shaft 12 proximate the first edge 46. The lever 18 has a pawl 50 extending inwardly from the first edge 46 along the front 52 of the latch member 14 so that upon movement of the second edge 48 outwardly from the recess 22, the pawl 50 contacts the front 52 of the latch 14 to rotate it.

Figure 3:
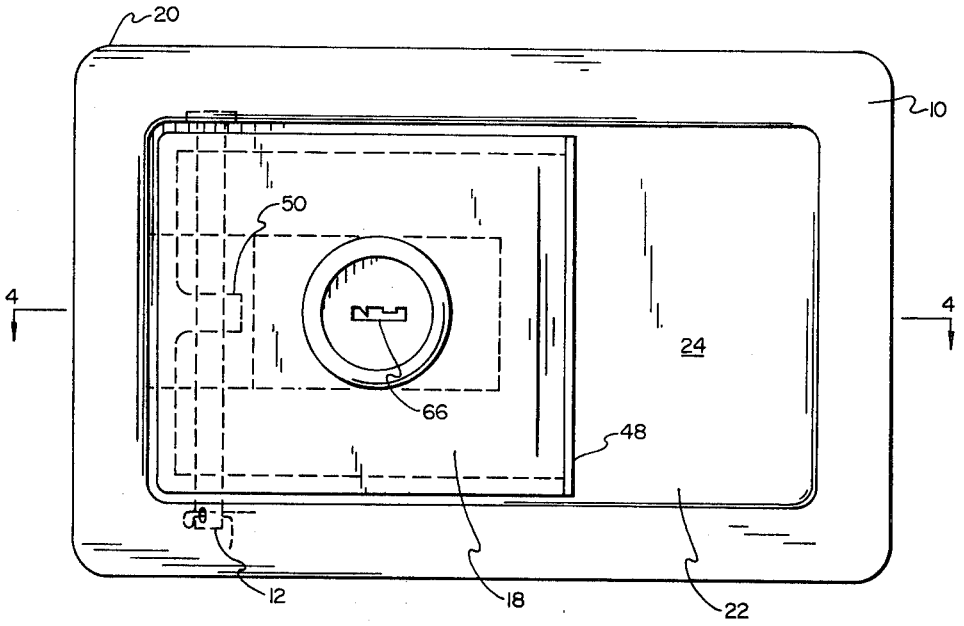
FIG. 3 is a top view of a door latch of the instant invention.
Figure 4:
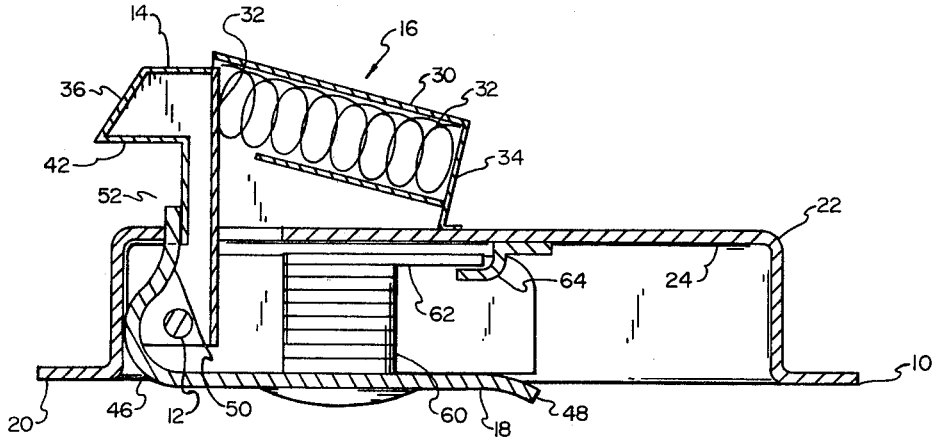
FIG. 4 is a sectional side view of the door latch of the instant invention along the section lines 4—4 of FIG. 3.

Referring now to FIG. 4, locking means are provided for the door latch of the instant invention. As here shown, the locking means is comprised of a key cylinder 60, a pawl 62 adapted to the key cylinder 60 and a ledge member 64 mounted to the bottom 24 of the recess 22. A key (not shown) is insertable into a key slot 66 (FIG. 3) to rotate the cylinder 60 and in turn the pawl 62 to move under the lip of the ledge member 64, as known to those skilled in the art.

Figure 2:
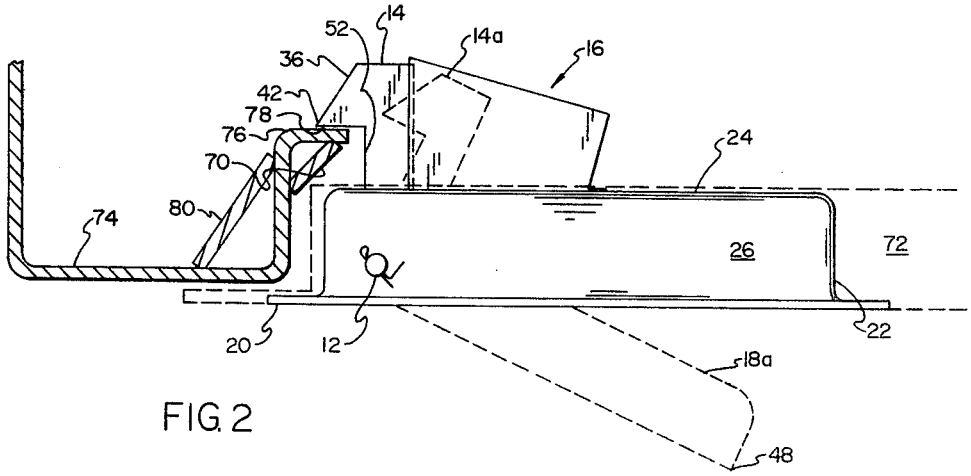
FIG. 2 is a side view of the door latch of the instant invention.

In use, the latch of the instant invention includes a striking plate 70 mounted to adjoining structure. As best shown in FIG. 2, the latch is preferably mounted in a double walled metal door 72 typically used for lockers or compartments on equipment trucks and the like. The striking plate 70 is mounted to the adjoining structure 74 associated with the locker door 72. The striking plate 70 has a wear surface (not shown) and is positioned with respect to a flange 76 formed in the adjoining structure 74 to form a lip 78 to coact with the latching lip 42 of the latch member 14. The flange 76 may be reinforced by structure 80 to minimize bending and flexing of the flange 76 as necessary based on, for example, the grade of the material associated with the structure used to form the structure 74.

In operation, the second edge 48 of the lever 18, which as here shown is a paddle handle, is moved from a latched position, as shown in FIG. 1, to the unlatched position, as shown in FIG. 2, to thereby disengage the latching lip 42 from the lip 78 of the flange 76. Thereupon the door 72 is free to be swung open by the user. After opening, the user may release the second edge 48 of the paddle 18 allowing it to return to the latched position, as shown in FIG. 1. Thereupon the latching member 14 is urged by the spring 32 to assume the latched position, as shown in FIG. 1. To close the door, the operator need only apply a minimal closing force to swing the door 72 toward a closed position. As the door swings into the closed position (as shown in FIG. 2), the striking surface 36 of the latch member 14 contacts the strike plate 70. The closing force applied by the user must be of sufficient magnitude to overcome the biasing force applied by the string 32. Presuming such force is applied, the striking surface of the latch member 14 slides across the strike plate 70 rotating the latch member 14 towards the unlatched position until the lip 42 of the latch member clears the lip 78 of the flange 76. Thereupon, the spring 32 urges the latch member 14 outwardly to the latched position, as shown in FIGS. 1 and 2.

It may be noted that the latch member 14 rotates about the shaft 12. Thus, the latch member 14 is not susceptible to excessive friction as heretofore known in latches. That is, the latch member 14 need only rotate about the shaft 12 into the housing 30. The housing 30 is provided to keep the spring 32 from fouling or otherwise interacting with the contents within or inside the door 72. Further, as hereinbefore noted, the housing 30 is sized to allow the latch member 14 to freely pass therein without surface contact between the surfaces of the latch member 14 and the inner surfaces of the housing 30. Indeed, the housing is preferably sized to tolerate substantial corrosion buildup without surface contact. Therefore, the friction forces to resist movement of the latch member which in turn make opening and closing of the door 72 difficult are avoided. Further, it may be noted, that the resolution of static and dynamic forces with respect to a rotatable latch member of the instant invention as opposed to a latch member which moves parallel to the back of a recess as heretofore known in the art are less. That is, the closing force necessary to close the door 72 is of a lesser magnitude than heretofore known with substantially similar biasing forces. In turn, the wear on the door, its hinges and the latch itself is reduced improving the life and the utility of the latch.

The door latch of the instant invention is regarded as particularly useful for doors constructed of lightweight material including, for example, aluminum, fiberglass and the like. The closing forces necessary to close a door using latches heretofore known are of such a magnitude that the lightweight material doors suffer damage (cracking, warping, bending). The force to close the door 72 using the latch of the instant invention is reduced as compared to latches heretofore known. In turn, the damage which might be imparted to the lightweight doors in use is reduced or eliminated.

It is to be understood that the embodiments of the invention above described are merely illustrative of the application of the principles of the invention. Reference herein to details of the illustrated embodiment is not intended to limit the scope of the claims which themselves recite those features regarded as essential to the invention.

I claim:

1. A door latch comprising:

a mounting member which is rectalinear in shape and formed with a flange about its perimeter, said mounting member having mounting means and a recess formed in its front, said recess being rectalinear in shape and having a bottom and sides with an aperture formed in said bottom;

a shaft secured to said mounting member in said recess proximate said aperture;

a latch member having a bottom, top, front, back and two spaced apart legs extending along its bottom toward its front is mounted to said shaft through said legs proximate said bottom to extend from said recess through said aperture with a striking surface inward of said bottom which angles from said top frontwardly toward said bottom to form a latching lip, said aperture being sized so that said latch member is rotatable between a latched position and an unlatched position;

biasing means secured to said mounting member to bias said latch member toward the latched position; and a rectalinearly shaped paddle which has a first edge opposite a second edge and which is positioned within said recess and mounted to said shaft along said first edge, said paddle having a pawl extending inwardly from said first edge along the front of said latch member between said legs to coact with said latch member so that upon movement of said second edge outwardly from said recess said pawl contacts said latch and rotates it from said latched position to said unlatched position upon operation of said paddle.

2. The door latch of claim 1 wherein said biasing means includes a housing mounted to and inwardly from said bottom proximate said latch member and a spring compressably mounted between said housing and the back of said latch member.

3. The door latch of claim 1 further including a striking plate mounted to adjoining structure, said plate having a striking surface angulated substantially identically as the angle of the striking surface of said latch member, and a lip, said striking plate being positioned to coact with said latch member.

4. The door latch of claim 1 further including locking means comprised of a key cylinder and a pawl adapted thereto mounted to said lever and a ledge member mounted to said bottom of said recess, said pawl being movable under said ledge by operation of said key cylinder.

5. For a door latch of the type having a paddle handle positioned within a recess formed in a mounting member and having a latch member biased to the latched position, the improvement comprising:

a shaft secured to said mounting member in said recess proximate an aperture formed in the bottom thereof;

said latch member mounted to said shaft to extend from said recess through said aperture with a striking surface inward of said bottom, said aperture being sized so that said latch member is rotatable between a latched position and an unlatched position;

biasing means secured to said mounting member to bias said latch member toward the latched position; and said paddle mounted to said shaft within said recess with means to coact with said latch member to rotate said latch member from said latched position to said unlatched position upon operation of said paddle.

6. For a door latch of the type having a paddle handle positioned within a recess formed in a mounting member and having a latch member biased to the latched position, the improvement comprising:

a shaft secured to said mounting member in said recess proximate an aperture formed in the bottom thereof;

said latch member having a bottom, top, front and back which is mounted to said shaft proximate said bottom to extend from said recess through said aperture with a striking surface inward of said bottom which angles from said top frontwardly toward said bottom to form a latching lip, said aperture being sized so that said latch member is rotatable between a latched position and an unlatched position;

biasing means secured to said mounting member to bias said latch member toward the latched position, said biasing means including a housing mounted to and inwardly from said bottom proximate said latch member and a spring compressably mounted between said housing and the back of said latch member; and said paddle mounted to said shaft within said recess with means to coact with said latch member to rotate said latch member from said latched position to said unlatched position upon operation of said paddle.

7. The improvement of claim 6 wherein said lever has a first edge opposite a second edge and is mounted to said shaft along said first edge, and wherein said lever has a pawl extending inwardly from said first edge along the front of said latch member so that upon movement of said second edge outwardly from said recess said pawl contacts said latch and rotates it, and wherein said latch member has two spaced apart legs extending along its bottom toward its front, said latch member being mounted to said shaft through said legs, and wherein said pawl is positioned between said legs.

* * * * *